US008631839B2

(12) United States Patent
Meinzinger

(10) Patent No.: US 8,631,839 B2
(45) Date of Patent: Jan. 21, 2014

(54) APPARATUS FOR BOTTLING MULTI-COMPONENT BEVERAGES

(75) Inventor: Rupert Meinzinger, Kirchroth (DE)

(73) Assignee: Krones AG, Neutraubling (DE)

( * ) Notice: Subject to any disclaimer, the term of this patent is extended or adjusted under 35 U.S.C. 154(b) by 684 days.

(21) Appl. No.: 12/833,592

(22) Filed: Jul. 9, 2010

(65) Prior Publication Data

US 2011/0023994 A1 Feb. 3, 2011

(30) Foreign Application Priority Data

Jul. 10, 2009 (DE) ..... 10 2009 032 791

(51) Int. Cl.
*B65B 1/04* (2006.01)

(52) U.S. Cl.
USPC ..... 141/105; 141/104; 141/107; 141/302

(58) Field of Classification Search
USPC ..... 141/9, 63, 64, 100, 102, 104, 105, 107, 141/90, 301, 302, 94
See application file for complete search history.

(56) References Cited

U.S. PATENT DOCUMENTS

| | | | | |
|---|---|---|---|---|
| 5,829,476 | A | 11/1998 | Kaneko et al. | |
| 6,463,807 | B1 * | 10/2002 | Feller | 73/861.12 |
| 2009/0236007 | A1 | 9/2009 | Clusserath et al. | |
| 2011/0039044 | A1 | 2/2011 | Clusserath | |

FOREIGN PATENT DOCUMENTS

| | | | |
|---|---|---|---|
| DE | 10 2004 028 576 | A1 | 12/2005 |
| DE | 10 2006 045 987 | A1 | 4/2008 |
| EP | 0 775 668 | A1 | 5/1997 |
| EP | 1 362 825 | B9 | 11/2003 |
| WO | 2009/129937 | A1 | 10/2009 |
| WO | 2010/017888 | A1 | 2/2010 |

* cited by examiner

*Primary Examiner* — Jason K Niesz
(74) *Attorney, Agent, or Firm* — Novak Druce Connolly Bove + Quigg LLP

(57) ABSTRACT

An apparatus for filling liquids and in particular beverages into containers, including a filling device for filling the liquid into the containers, including a liquid line which supplies the liquid to the filling device, wherein the liquid in the liquid line flows in a first flow direction and wherein a flow measuring device is disposed in the liquid line, which flow measuring device determines the quantity of the liquid passing through the flow measuring device in the first flow direction. According to the invention, the flow measuring device is designed in such a way that it also determines the quantity of the liquid passing through the flow metering device in a second flow direction which is opposite to the first flow direction.

14 Claims, 3 Drawing Sheets

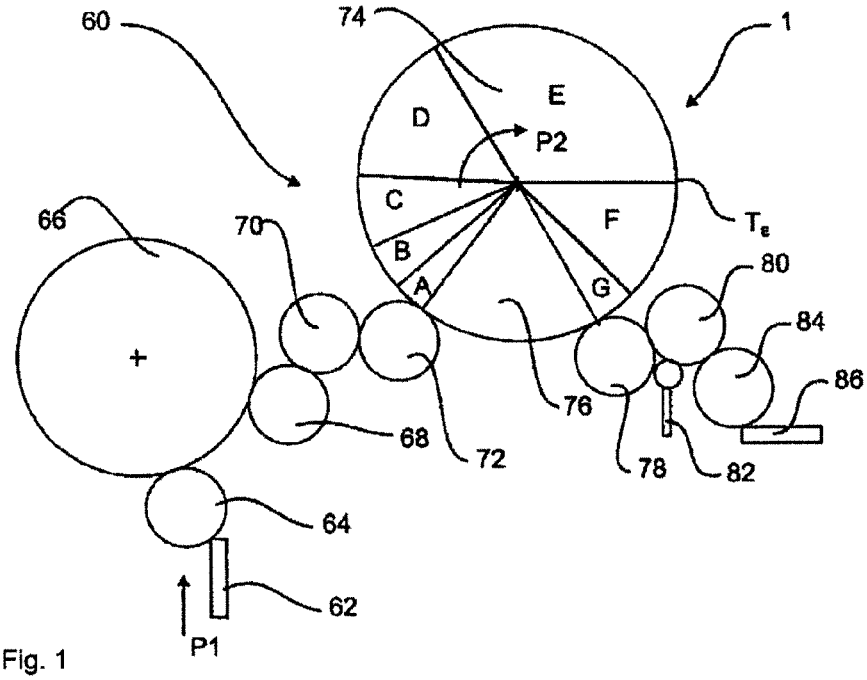
Fig. 1
Fig. 2
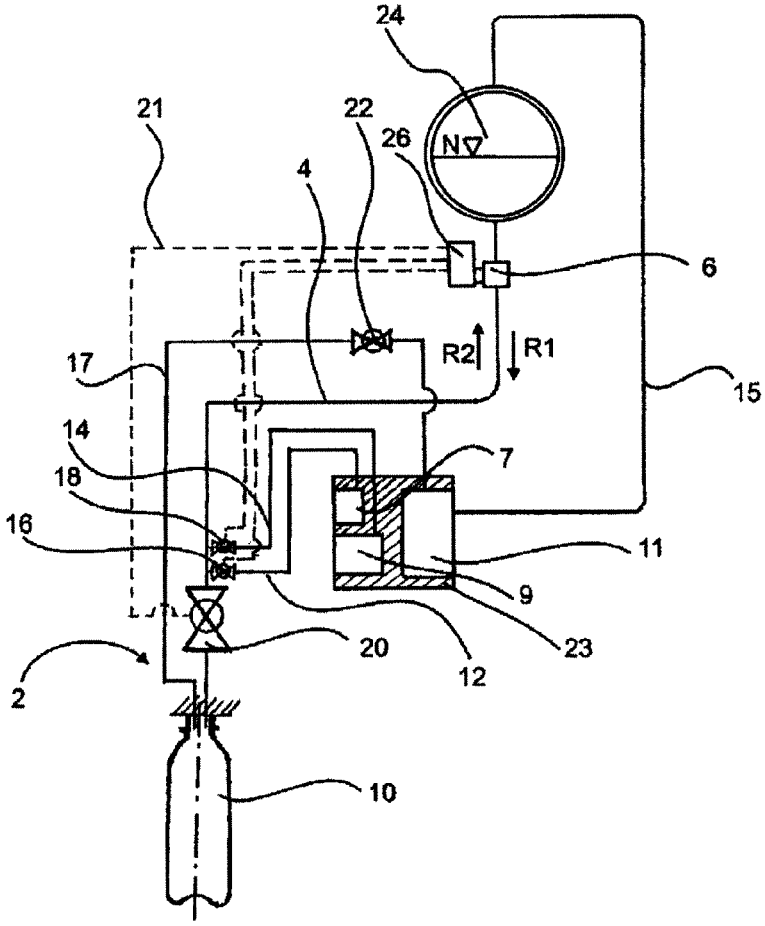

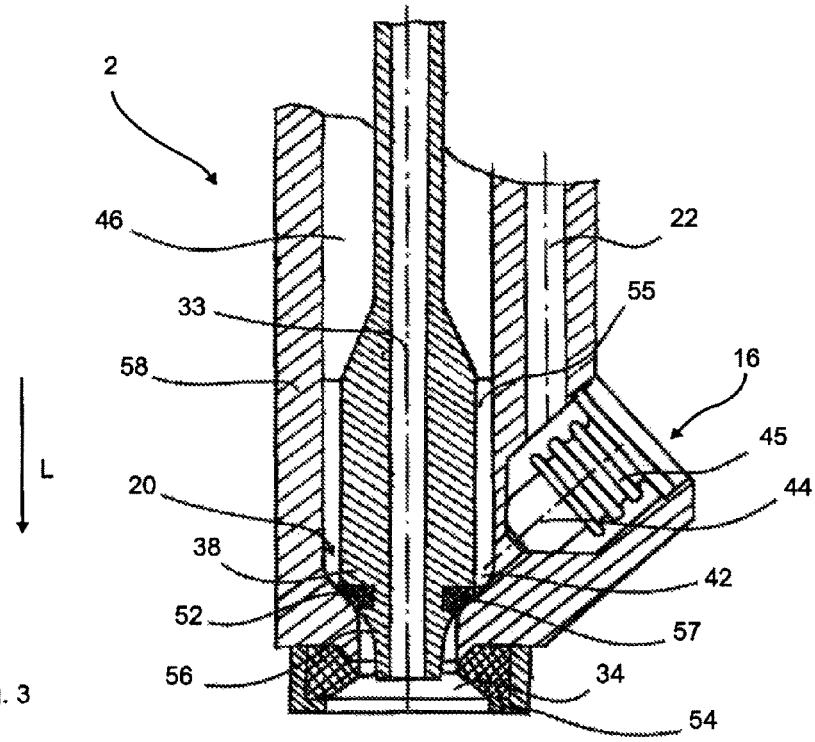
Fig. 3
Fig. 4
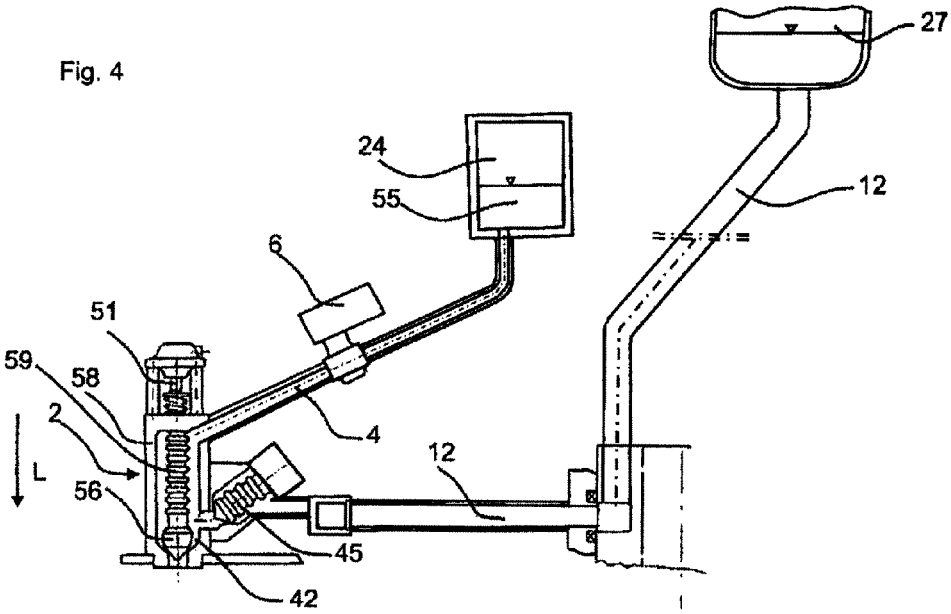

APPARATUS FOR BOTTLING MULTI-COMPONENT BEVERAGES

CROSS-REFERENCE TO RELATED APPLICATION

This application claims the benefit of priority of German Patent Application No. 10 2009 032 791.6, filed Jul. 10, 2009, pursuant to 35 U.S.C. 119(a)-(d), the disclosure of which is incorporated herein by reference in its entirety as if fully set forth herein.

TECHNICAL FIELD

The present disclosure relates to an apparatus for bottling liquids and, more particularly, an apparatus for bottling beverages.

BACKGROUND

Apparatuses for bottling liquids have been known from the prior art for a long time. Aspects of the disclosure are specifically described in relation to an apparatus for bottling multi-component beverages, which means for example beverages which are composed of a syrup and an aqueous medium. However, it is to be noted that the present disclosure may also be applied to other apparatus for bottling beverages and other liquids such as milk, juices, liquid refreshments or oils, and also to more viscous media.

In apparatus of this kind for bottling beverages, usually several flow measuring devices are used, which determine the flow rate of the respective component. Such flow measuring devices are sometimes susceptible to interference, and faults when measuring quantities will immediately lead to undesired mixtures of the beverage to be bottled. In particular in the case of liquids interspersed with particles, such flow measuring devices do frequently not work reliably.

From DE 10 2006 045 987 A1, a method for filling containers with a liquid product as well as a filling system are known. Here, at least two components of the product are mixed together. At least one of the components is supplied here using a flow meter in a manner in which both the filling quantity and the volume are controlled.

EP 1 362 825 B9 describes a rotary machine for filling containers. Here, a supply device for additives includes several pipes, with means for blocking the opening of the pipes being arranged along the pipes, in order to open and close the latter. U.S. Pat. No. 5,829,476 discloses a filling valve having two flows, with one supply channel being disposed within the other.

It may therefore be desirable to provide an apparatus and a method which allow a simplified filling of beverages into containers and preferably also a simplified overall operation of the system. Moreover, possibilities are to be provided in order to reduce the number of necessary measuring devices for determining the filling quantity.

SUMMARY OF INVENTION

An apparatus according to the disclosure for filling liquids and in particular beverages into containers includes a filling device for filling the liquid into the containers. Further, a liquid line is provided which supplies the liquid to the filling device, wherein the liquid in the filling line flows in a first flow direction and a flow measuring device is disposed in the liquid line, which determines the quantity of liquids passing through the flow measuring device in the first flow direction.

According to the invention, the flow measuring device is designed in such a way that it also determines the amount of the liquids passing through the flow measuring device in a second flow direction which is opposite to the first flow direction.

According to the disclosure it is now proposed to provide a flow measuring device which determines not only the volume according to the amount of liquid passing through, but also allows a distinction with regard to the flow direction to be made. In this way, for example, when supplying a second component, this may be added downstream of the flow measuring device, as a result of which a temporary return flow of the first liquid component takes place. Based on this return flow or the quantity thereof, the quantity of the supplied second component may be determined. However, it is to be noted that the second liquid does not necessarily have to be a second component. Thus, the invention would also be applicable in order to pass for example a cleaning medium through the apparatus during a cleaning operation, and the flow measuring device could here also determine the quantity of the cleaning medium.

In an exemplary embodiment, the apparatus includes a filling state measuring device which determines the filling level of the containers to be filled. Here, for example, load cells could be provided which weigh the individual containers to be filled, in particular during the filling process. However, the filling state measuring devices could also be a filling level probe or they could be other flow measuring devices which determine the quantity of product flowing immediately into the containers.

In an exemplary embodiment, the apparatus includes a second liquid line, in order to supply a second liquid to the filling device. In this embodiment, the invention is particularly suitable for producing multi-component beverages. On the other hand, this second liquid line could also be a flushing line which supplies a detergent to the filling device for the cleaning thereof, for example in a specific cleaning operation.

In an exemplary embodiment, the second liquid may be brought in fluid communication with the first liquid. For example, the second liquid may be brought in fluid communication with the first liquid in front of an outlet of the filling device. In this way, for example, the filling in of a beverage may be stopped and subsequently a second component may be supplied in a mixing area, and the quantity of this second component is determined by means of the flow measuring device in a return flow direction.

In an exemplary embodiment, the second liquid line opens into the first liquid line. In this way, a mixing process in the area of this opening may be carried out and in this way the system may be controlled in such a way that at the beginning of a specific filling operation of a container and towards the end thereof, only one particular product may be used in each case, for example water which contains no pieces of fruit or the like.

In some aspects, the second liquid line is arranged in such a way that during operation of the apparatus, the second liquid does not pass through the flow measuring device. This is of particular importance where the second component is a liquid with pieces of fruit or the like. In this case it is to be ensured that the volume between the flow measuring device and the opening into the second liquid line is sufficiently large so that when supplying a second medium this cannot pass through the flow measuring device, since the measurements might be affected otherwise.

In an exemplary embodiment, the filling device includes a valve means in order to control the supply of at least one liquid into the container. This valve means is here advantageously provided downstream of the opening of the second liquid line into the first liquid line, so that only one valve is provided which controls the supply of the mix already produced into the containers.

In an exemplary embodiment, the apparatus includes a reservoir for the first liquid. Apart from that, also reservoirs for a second liquid such as for example annular channels may be provided.

In an exemplary embodiment, a controllable valve is provided in the second liquid line. This means that the second component may be added in a metered manner by means of this valve. In some aspects, this valve is controlled on the basis of the data from the flow measuring device. Thus, for example, this valve may be opened in order to supply the second component, and as soon as the flow measuring device determines a certain amount of liquid (in particular in the backward flow direction), the valve may be closed again. For example, the valve means of the filling device will be closed during this time.

The present disclosure is further directed to a method for filling liquids and in particular beverages into containers, wherein a first liquid is filled into the containers by means of a filling device and the liquid is supplied to the filling device along a first liquid line, wherein the liquid flows in a first flow direction and wherein a flow measuring device determines a quantity of the liquid passing through the flow measuring device in the first flow direction.

According to the invention, liquid flows at least temporally in the liquid line in a first flow direction opposite to a second flow direction and the flow measuring device determines a quantity of the liquid passing through the flow measuring device in the second flow direction.

Thus, it is proposed also from the point of view of the method to measure the quantity particularly of the first liquid in both flow directions, in order to be able to draw conclusions with regard to the quantity of a supplied second medium or for example a flushing medium.

In an exemplary method, a second liquid is supplied to the containers and there is at least temporally a fluid communication between the first liquid and the second liquid. For example, during the supply of the second liquid, a main valve feeding the liquid into the containers is closed. In this way, by supplying the second liquid, a return flow of the first liquid through the flow measuring device is caused, so that on the basis of the values output by the flow measuring device a conclusion may be drawn with regard to the quantity of supplied second liquid. The fluid communication is therefore preferably established upstream relative to the valve means of the filling device.

Thus, in an exemplary method, a quantity of second liquid to be filled into the container is determined on the basis of a flow rate of first liquid passing through the flow measuring device in the second flow direction.

In an exemplary method, a control device controls at least one valve as a function of measurement signals, which valve controls the supply of the second liquid into the container.

In an exemplary method, also a gaseous product is supplied to the container. This may for example be $CO_2$, if it is desired to fill a carbonated liquid. This supply of gas, however, may also be carried out prior to filling in the liquid. When bottling still beverages, nitrogen might be supplied, for example prior to and/or after the filling operation.

In an exemplary method, a third liquid is supplied to the containers and there is at least temporally a fluid communication between the first liquid and the third liquid.

In some aspects, the second liquid and the third liquid are supplied to the filling device in a time-delayed manner. By means of this time-delayed supply, just one flow measuring device may be used to determine the quantities of both the second and third liquids.

Some further advantages and embodiments may become evident from the attached drawings.

BRIEF DESCRIPTION OF THE DRAWINGS

In the drawings:

FIG. 1 shows a schematic view of a system for filling beverage containers in accordance with various aspects of the disclosure;

FIG. 2 shows a view in the form of a block diagram of an aspect of the present disclosure;

FIG. 3 shows a sectional view of a filling device in accordance with various aspects of the disclosure;

FIG. 4 shows a schematic sectional view of a filling device in accordance with various aspects of the disclosure;

DETAILED DESCRIPTION

Figure 5:
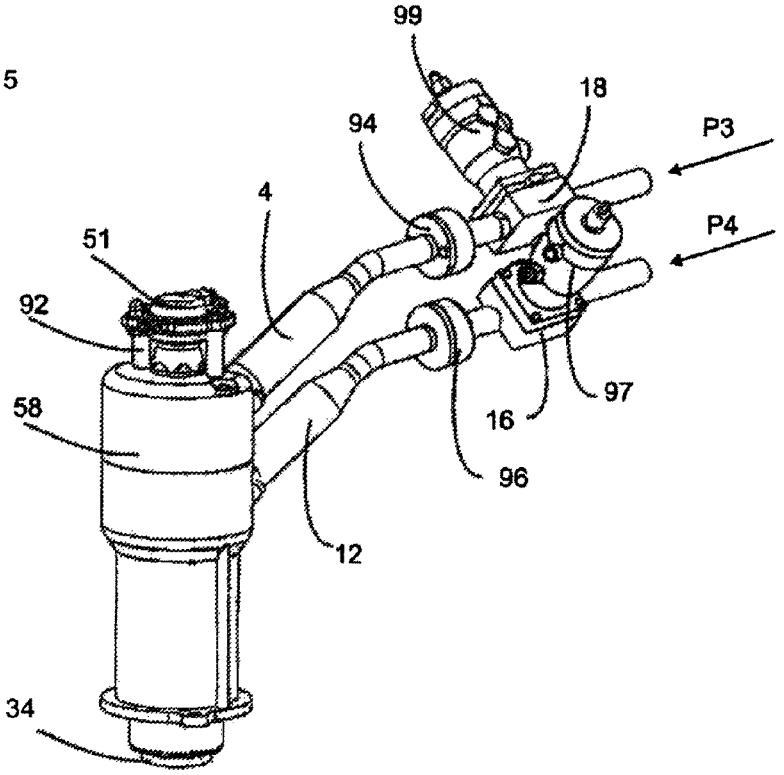
FIG. 5 shows a perspective view of a filling device in accordance with various aspects of the disclosure.

FIG. 1. shows a schematic view of an exemplary system 60 for filling containers. This system 60 includes a container supply 62 which supplies containers along the arrow P1 via an in-feed star wheel 64 of a rinsing device 66 or a rinser.

An out-feed star wheel 68 of the rinsing device 66 takes over the rinsed containers and passes them on via a transfer star wheel 70 and a filler inflow star wheel 72 to an apparatus 1 for bottling beverages. In this apparatus 1, two-component beverages are bottled. Reference letters A to G identify different method steps carried out when bottling the beverages. Thus, in a step A, the container is pressed against a filling device, and in a step B, the container is preloaded or a gaseous medium such as for example carbon dioxide is applied to it. In a step C, an initial amount of a clear main product is filled into the container, such as for example a carbonated beverage. In a step D, a secondary product may be supplied or a secondary product plug may be filled into the main product. In sector E, a post-filling of the main product takes place. Reference letter $T_E$ identifies the end of the filling process of the beverage into the container.

In a step F, the bottled beverage may be allowed to settle or to relax, and in a step G, the container is removed from the filling device.

Reference numeral 78 relates to an out-feed star wheel of apparatus 1 and reference numeral 80 relates to a closing device, in order to close the containers with closures, and reference numeral 82 relates to a supply device for the container closures. Reference numeral 84 identifies an out-feed star wheel of the closing means and reference numeral 86 relates to a take-off device for transporting off the filled containers.

Reference numeral 76 identifies a dead angle in which no containers are filled or in which no containers are present in corresponding filling stations. In this dead angle between the filler out-feed star wheel and the filler in-feed star wheel, a metered amount of an additive product may be added to the main product. Thus, this angle is also used for the filling process and in this way the overall performance of the filler may be enhanced, since the metering process does not always have to be carried out in the angular range (A to G) that is usually available. This metering process will be described in more detail with reference to the further figures. From the point of view of the method it is therefore suggested to add the metered quantity of further liquid to the first liquid with a time delay after the filling of the container.

Thus, the apparatus shown in FIG. 1 is also used for mixing beverages from at least two or more different liquids. These liquids may for example be water, syrup and/or flavouring agents in a predetermined mixing ratio relative to the container volume to be filled. Here, too, the various liquids may be advantageously mixed together within the space that follows the point of distribution to the individual filling valves. Within the context of an aspect of the invention it is suggested to carry out the bringing together of the different media so closely to the filling valve outlet, that the medium added may be automatically discharged during the subsequent container filling process. By means of this approach, each subsequent filling may be varied by supplying several different flavouring agents. Besides, in this way critical product such as for example pulp may be flushed away from the valve device or the valve cone.

FIG. 2 shows a view in the form of a block diagram of an exemplary apparatus 1 according to the disclosure. From a reservoir 24 for the main product, the product will flow to the filling device 2 which is generally identified here with the reference numeral 2 and is not shown in more detail, via a first liquid line 4. A flow measuring device 6 is adapted to measure the liquid flow in the direction R1. In some aspects, the flow measuring device 6 is an inductive flow meter.

A filling valve 20 controls the filling of liquid into the container 10. Here, a secondary product such as syrup may be supplied to the liquid line 4 or the filling device 2 via a second liquid line 12 fed from an annular channel 7.

During the filling process, the valve 20 may be closed and subsequently the valve 16 for supplying the secondary liquid may be opened. This in turn causes the main liquid to be pushed back in the liquid line 4 and thus to flow into the area of the flow meter in the flow direction R2.

Since the flow measuring device 6 is also suitable for determining the flow in the direction R2, it is possible to determine on the basis of these measurements how much liquid was supplied via the line 12. However, here the length of this liquid line 4 is preferably dimensioned such that the product present in the line 12 will not itself be pushed through the flow measuring device 6.

A control device 26 receives the measurement signals of the flow measuring device 6 and drives for example the valve 16, but also the valve 20. In this way, an automated filling of the container may be achieved. The control device may also be installed at a remote location and in this case the measurement signals from the flow metering device are transferred to the control device and the remote control device will then drive the valves.

As has already been mentioned, when adding metered products via the liquid line 12, for example product pieces, these must not be pushed through the flow measuring device 6, because this would affect the accuracy of the measurement. Therefore, the volume of the product line between the flow meter and the actual metering point will have to be dimensioned correspondingly, so that only the main product is pushed back through the flow measuring device 6.

It is also possible here for the second liquid line (secondary product line 12) to be further away from the valve outlet of the filling device 2 into the main product line in the direction of the flow metering device 6 or to form the first liquid line 4. In this way, clear liquid may be filled in, i.e. the secondary product is filled in as a plug between two parts of the main product. In this case, however, it may be taken into account that the subsequent part of the main product is large enough to flush the secondary product, i.e. the second liquid, completely out of the valves.

This filling in of a clear liquid has the advantage that when adding metered amounts of fruit cells or fruit pieces immediately during the opening of the valve or the valve cone thereof, a perfect filling jet is generated. If fruit cells are present on the valve cone during opening, then these may interfere with the immediate formation of the filling jet, which could cause an uncontrolled splashing about of product.

FIG. 2 shows a radial supply of the secondary product via the line 12. However, it would also be possible for this metered adding of secondary product to take place in other directions, for example tangentially or in a different way obliquely into the first line 4. In this way, the thorough mixing of main and secondary products in the main line 4 may be improved, as a result of which flushing out of the secondary product will be simplified.

A third liquid line 14 may be used to supply a further liquid for example via an annular channel 9. Here, too, a valve 18 is provided which controls the supply of this product into the filling device 2 or the valve 20.

A channel 11 for a gaseous medium such as for example carbon dioxide is in contact with the reservoir 24 via a connection line 15, in order to form a gaseous phase in this reservoir or to apply a load on the main product, the filling level of which is identified here with the reference letter N. A further connection line 17 connects the channel 11 with the container. This channel 17 is a return gas channel which feeds $CO_2$ back into the channel 11 during the filling process of the containers. Reference numeral 22 relates to a valve which is used here as a return gas valve and a pre-charge valve.

Control lines 21, for example, electrical control lines, are in communication with the individual valves 20, 16 and 18 via the control unit 26.

The secondary medium, which is supplied via the liquid line 12, may be fed in at a higher pressure than the product in the first liquid line 4. In this way, on the one hand a pushing back of the product in the liquid line 4 may be achieved, and on the other hand it is possible to bring together in this way two liquids interspersed with gas. A pressure higher than that for the liquid in the first liquid line 4 may also be used for the liquids in the third liquid line 14.

The dosage area or the dosage position may be implemented in any nozzle form or as a diffuser depending on the product, as a result of which the thorough mixing upon dosing will be improved. It would also be possible to add the syrup or the additional product in a metered way under $CO_2$ pressure during counter-pressure filling or to add the syrup in a condition in which it is already slightly "carbonated". In this way, any possible $CO_2$ dissociation caused by turbulences in the mixing area may be counteracted.

The return gas channel 17 could also be used as a CIP (cleaning in place) return channel. It would also be possible here to provide a branch going off from this channel into a CIP return path, for example downstream of the valve block using return gas and/or pre-charge valves. In particular, in more complex filling processes, the valve block (not shown) includes several gas valves for various functions, via which the return gas channel will then be divided up into several gas channels in the channel carrier 23.

It would further be possible, in the case of an implementation with several dosage points on a filling valve, to use the filling device also for "multicoloured filling", wherein different products are filled in from one filling valve to another, or a filling process depending on commissions is carried out or the various products are filled one after the other within the same production shift, where a very quick changeover from one product to another may be carried out.

In order to control this filling process known from the prior art, the apparatus according to the disclosure—which may be used in the same way as for the filling process according to the invention—includes a filler control device (not shown), such as an SPS.

FIG. 3 shows a filling device 2 according to one aspect of the disclosure. This filling device or this filling valve includes a valve means 20 which in turn has a valve body or a valve plunger 38. Reference numeral 12 relates to the second liquid line for supplying the secondary product. This secondary product will be fed via a valve 16 through a connection line 44 into a mixing chamber 42. Reference numeral 34 identifies the outlet of the valve 20, from which liquid is fed into the containers. Reference numeral 54 identifies a housing of the filling device. Return gas such as for example $CO_2$ may be carried off again via a return gas channel 33. The valve body 38 may be moved in the longitudinal direction L thereof and may control in this way the supply of product to the outlet 34 and thus into the container.

To this end, the valve has a sealing washer 52 which in the closed state of the valve pushes against a housing section 57 and thus closes the valve. Reference numeral 56 identifies the corresponding valve cone.

A supply channel 46 supplies the main product within the filling device. It can be seen that the channel 46 is either close or immediately adjacent to the valve area. Reference numeral 55 identifies the product to be filled in.

The filling device 2 shown in FIG. 3 may be particularly useful for mixing and bottling carbonated liquids mixed with syrup, in particular in combination with fruit fibres. It is already known from the prior art to feed two liquids from two separate containers into a common mixing chamber. Usually a filling system is used here for filling in liquids having a proportion of fibres or solids, which is sealed immediately before the outlet of the filling valve. In the case of this special outlet geometry, no product will be present upon sealing at the end of the filling process, so that a gas barrier may be dispensed with. A gas barrier is a component which prevents, by utilising the surface tension, liquids from escaping from a line that is open on one side. Such gas barriers, however, are not suitable for larger proportions of fruit fibres.

However, this proven system for retaining and switching off is resorted to also within the context of the disclosed apparatus and methods. However, an improved or flow-optimised feeding to the filling valve outlet 34 is provided which, as was mentioned above, is sealed off by means of the cone 56. For any further medium to be added, for example via the line 44, a further feeding line leads to the common mixing chamber 42 which is designed in such a way that the mixing of the various media from one filling to another may be reproduced.

In order to ensure the desired sequence of the filling process, each feeding line includes a shut-off mechanism, such as the valve 16 here. The various dosing quantities of the media supplied may be measured with known measuring means, such as for example by means of a flow measuring device (not shown).

In some aspects, a dosage of one, several or all of the media is further provided via a certain volume stream and flow duration. A prerequisite for this is that the liquids are brought together at a location as closely as possible to the outlet 34 and have an appropriate constitution.

FIG. 4 shows a further view of an apparatus according to the invention, which may be particularly suitable for bottling liquids including a secondary product containing fruit pieces or fibres. Apart from the actual filling device 2, also the environment thereof can be seen here, i.e. in particular the first supply line 4 and the second supply line 12 for the secondary product. This second supply line 12 is fed from a reservoir 27, which is positioned here at a higher level than the reservoir 24, so that the liquid reaches the filling device 2 under a higher pressure than the liquid in the liquid line 4. An actuating device 51 may actuate the valve body 56 in the longitudinal direction 11, such as for example a pneumatic drive. Reference numeral 58 in turn identifies the housing of the filling device 2. The valve 16 includes a bellow member 45, which is a component of the valve 16, so that the valve area, too, may be surrounded by the liquid. A corresponding bellow 59 is also provided in the filling device 2 and may therefore be surrounded by the main product coming from the feed line 4.

During the filling process, initially the first medium to be filled in, for example the main product, is filled in by opening the corresponding valve into the media supply and closing the other ones. Subsequently, or at the same time, the outlet of the filling valve is opened or the valve 20 is opened. Once the desired partial amount is reached, the filling valve outlet 34 is closed again. However, media may also be changed over with the valve 20 opened (cp. FIG. 2) if this is carried out without any overlap. As was mentioned above, the subsequent medium will displace the preceding medium, so that a reproducible mixing ratio is achieved.

According to various aspects, each feed line may include a separate shut-off mechanism or valve for the liquid here.

FIG. 5 shows a further view of a filling device 2 according to the invention as well as the environment thereof. A valve drive 51 may drive the valve which is mounted on a housing 58 by fastening means 92. Reference numeral 34 again identifies the valve outlet. Here, shutters or throttles 94, 96 are disposed in the two product lines 4 and 12. The products will be supplied as shown by the arrows P3 and P4. Reference numerals 16, 18 each relate to a diaphragm valve actuated by a drive 97, 99, respectively.

Figure 6:
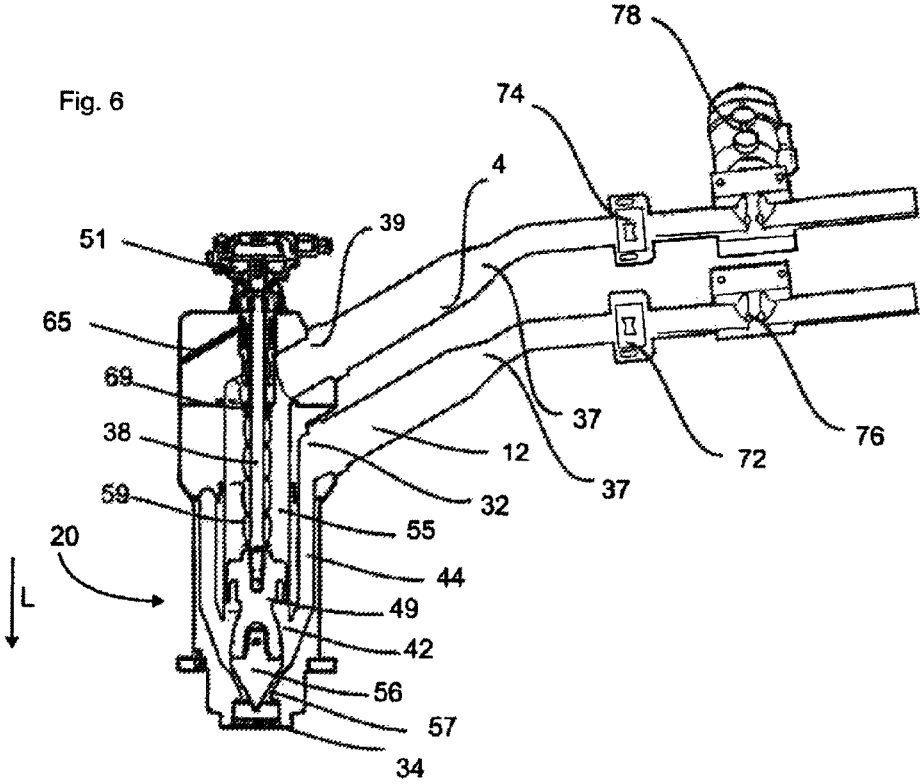
FIG. 6 shows a schematic sectional view of the filling device shown in FIG. 5.

FIG. 6 shows a sectional view of the filling device shown in FIG. 5. What can be seen here again is a valve cone 56 which may be moved in the direction L and which may rest against a valve seat 57. The main product is supplied along the first feed line 4 via a supply channel 55 into a mixing chamber 42. In this mixing chamber 42, the main product may be mixed with a secondary product (preferably with the valve 20 closed) coming from the product line 12. Here, the channel 44 for the secondary product completely surrounds the channel 55 for the main product in the circumferential direction.

A bellow 59 allows the formation of the channel 55 for the main product. Within this bellow, an actuation rod for actuating the valve is guided. Reference numeral 49 relates to a centring device for the valve cone 56. It can be seen here that the second port 32 for the secondary product (or the second liquid) is disposed at a lower level than the first port 39 for the main product (or the first liquid). Further, the channel 44 is adjacent to the valve cone 56, so that it may always be ensured that the container is filled with the main product at the beginning and is again filled with the main product towards the end.

Reference numeral 65 identifies a ventilation bore and reference numeral 69 identifies a return spring, in order to move the valve cone 56 into its closed position in the unconnected state. Thus, in the embodiment shown in FIG. 6, channel 44 is annularly shaped and surrounds the channel 55, as was mentioned above. Both feed lines 4 and 12 have an expansion area 37 each which are used for a flow-optimised supply of the two products.

By means of the arrangement shown in FIG. 6, any crossovers of the channels 44 and 55 may be avoided, or the two product channels lie inside of each other. The mixing chamber 42 is here located in the immediate vicinity of the valve body 56, and preferably also the feed lines or the two ports 32 and 39 are each provided above this mixing area 42.

It will be apparent to those skilled in the art that various modifications and variations can be made to the apparatuses and methods for bottling multi-component beverages of the present disclosure without departing from the scope of the invention. Other embodiments of the invention will be apparent to those skilled in the art from consideration of the specification and practice of the invention disclosed herein. It is intended that the specification and examples be considered as exemplary only.

What is claimed is:

1. An apparatus for filling liquids and in particular beverages into containers, including a filling device for filling the liquid into the containers, including a first liquid line which supplies a first liquid to the filling device, wherein the first liquid in the first liquid line flows in a first flow direction and wherein a flow measuring device is disposed in the first liquid line, which flow measuring device determines the quantity of the first liquid passing through the flow measuring device in the first flow direction, characterised in that the apparatus has a second liquid line in order to supply a second liquid to the filling device and the flow measuring device is designed in such a way that it also determines the quantity of the second liquid by determining the quantity of the first liquid passing through the flow metering device in a second flow direction which is opposite the first flow direction.

2. The apparatus as claimed in claim 1, characterised in that the second liquid may be brought in fluid communication with the first liquid.

3. The apparatus as claimed in claim 1, characterised in that the second liquid line opens into the first liquid line.

4. The apparatus as claimed in claim 1, characterised in that the second liquid line is arranged in such a way that during operation of the apparatus, the second liquid does not pass through the flow measuring device.

5. The apparatus as claimed in claim 1, characterised in that the filling device includes a valve means in order to control the supply of at least one liquid into the container.

6. The apparatus as claimed in claim 1, characterised in that a controllable valve is disposed in the second liquid line.

7. A method for filling liquids and in particular beverages into containers, wherein a first liquid is filled into the containers by means of a filling device and the liquid is supplied to the filling device via a first liquid line, wherein the first liquid flows in a first flow direction and wherein a flow measuring device determines a quantity of liquid passing through the flow measuring device in the first flow direction, characterised in that the liquid flows at least temporally in the liquid line in a second flow direction which is opposite to the first flow direction and the flow measuring device determines a quantity of liquid passing through the flow measuring device in the second flow direction.

8. The method as claimed in claim 7, characterised in that a second liquid is supplied to the containers and at least temporally a fluid communication exists between the first liquid and the second liquid.

9. The method as claimed in claim 8, characterised in that from a flow rate of the liquid passing through the flow measuring device in the second flow direction, a quantity of second liquid to be filled into the container is determined.

10. The method as claimed in claim 7, characterised in that a control device controls at least one valve depending on measurement signals, which valve influences the supply of the second liquid into the container.

11. The method as claimed in claim 7, characterised in that also a gaseous product is supplied to the container.

12. The method as claimed in claim 8, characterised in that a third liquid is supplied to the containers and a fluid communication exists at least temporally between the first liquid and the third liquid.

13. The method as claimed in claim 12, characterised in that the second liquid and the third liquid are supplied to a filling device in a time-delayed manner.

14. The apparatus as claimed in claim 2, characterised in that no flow measuring device is disposed in the second liquid line.

* * * * *